US005298875A

United States Patent [19]

Laibowitz et al.

[11] Patent Number: 5,298,875

[45] Date of Patent: Mar. 29, 1994

[54] CONTROLLABLE LEVITATION DEVICE

[75] Inventors: Robert B. Laibowitz, Peekskill; Gordon J. Lasher, Briarcliff Manor, both of N.Y.

[73] Assignee: International Business Machines Corporation, Armonk, N.Y.

[21] Appl. No.: 703,985

[22] Filed: May 22, 1991

[51] Int. Cl.[5] ..... H01F 7/22

[52] U.S. Cl. ..... 335/216; 310/12; 310/90.5; 505/879; 340/815.62; 40/426; 40/449

[58] Field of Search ..... 355/216; 310/90.5; 257/31-36; 505/1, 879; 361/141, 144; 340/815.05, 815.24, 815.1, 815.27; 40/426, 449

[56] References Cited

U.S. PATENT DOCUMENTS

| | | | |
|---|---|---|---|
| 3,327,265 | 6/1967 | Van Geuns et al. . | |
| 3,951,074 | 4/1976 | Cooper . | |
| 3,951,074 | 4/1976 | Cooper . | |
| 4,797,386 | 1/1989 | Gyorgy et al. . | |
| 4,843,504 | 6/1989 | Barnes . | |
| 4,879,537 | 11/1989 | Marshall et al. . | |
| 4,892,863 | 1/1990 | Agarwala . | |
| 5,011,818 | 4/1991 | Katoka et al. | 324/248 |
| 5,015,622 | 5/1991 | Ward et al. | 505/1 |
| 5,063,418 | 11/1991 | Shurtz et al. | 357/15 |
| 5,087,610 | 2/1992 | Hed | 505/1 |
| 5,109,164 | 4/1992 | Matsui | 307/306 |

FOREIGN PATENT DOCUMENTS

| | | |
|---|---|---|
| 186728 | 7/1989 | Japan . |
| 264277 | 10/1989 | Japan . |

OTHER PUBLICATIONS

"Observation of Enhanced Properties in Samples of Silver Oxide Doped $YBa_2Cu_3O_x$" by N. Peters et al. Appl. Phys. Lett. 522(24), Jun. 13, 1988.

"Levitation of a Magnet Over a Flat Type II Superconductor" F. Hellman et al. J. Appl. Phys. 63(2), Jan. 15, 1988.

"Magnetic Hysteresis of High-Temperature $YBa_2Cu_3O_x$-AgO Superconductors: Explanation of Magnetic Suspension" by C. Huang, Mod. Physics Letters B vol. 2, No. 7, Aug. 1988.

"Levitation Effects Involving High $T_c$Thallium Based Superconductors" W. Harter, Appl. Phys. Lett. 53(12) Sep. 19, 1988.

"Friction in Levitated Superconductors", E. Brandt, Appl Phys. Lett 53(16) Oct. 17, 1988.

"Magnetic Suspension of Superconductors at 4.2K", R. Adler et al., Appl Phys. Lett vol. 53, No. 5, Dec. 1988.

"Flux Penetration in High $T_c$Superconductors: Implications for Magnetic Suspension and Shielding", D. Marshall et al., Appl. Phys. A48, 87-91, 1989.

"Observation of Enhanced Properties in Samples of Silver Oxide Doped $YBa_2Cu_3O_x$" by N. Peters et al. Appl. Phys. Lett. 52(24), Jun. 13, 1988.

"Levitation of a Magnet Over a Flat Type II Superconductor" F. Hellman et al. J. Appl. Phys. 63(2), Jan. 15, 1988.

(List continued on next page.)

*Primary Examiner*—Leo P. Picard
*Assistant Examiner*—R. Barrerg
*Attorney, Agent, or Firm*—Perman & Green

[57] ABSTRACT

Apparatus for levitating a magnetic body. The apparatus includes a structure (10) comprised of a material that is superconductive below a critical temperature. The structure includes at least one Josephson junction device (14) for passing a variable current therethrough for controlling an amount of magnetic flux penetration into the structure. At a first current flow magnetic flux generated by a magnetic body (12) is excluded from the structure and the magnetic body is levitated above a surface of the structure. At a second current flow the magnetic flux penetrates the structure, causing he levitating magnetic body to approach a surface of the structure. Controllably applying a current to an array (30) of superconductive tiles (34), forming Josephson tunnel junctions (38), is shown to provide a lateral motion of, or a rotation of, the magnetic body relative to the surface.

26 Claims, 3 Drawing Sheets

OTHER PUBLICATIONS

"Magnetic Hysteresis of High-Temperature $YBa_2Cu_3O_x$-AgO Superconductors: Explanation of Magnetic Suspension" by C. Huang, Mod. Physics Letters B vol. 2, No. 7, Aug. 1988.

"Levitation Effects Involving High $T_c$Thallium Based Superconductors" W. Harter, Appl. Phys. Lett. 53(12) Sep. 19, 1988.

"Friction in Levitated Superconductors", E. Brandt, Appl. Phys. Lett 53(16) Oct. 17, 1988.

"Magnetic Suspension of Superconductors at 4.2K", R. Adler et al., Appl Phys. Lett vol. 53, No. 5, Dec. 1988.

"Flux Penetration in High $T_c$ Superconductors: Implications for Magnetic Suspension and Shielding", D. Marshall et al., Appl. Phys. A48, 87-91, 1989.

CONTROLLABLE LEVITATION DEVICE

FIELD OF THE INVENTION

This invention relates generally to superconductive materials and devices and, in particular, to a superconducting plane fabricated so as to enable the controlled levitation and positioning of magnetic bodies.

BACKGROUND OF THE INVENTION

The levitation of a magnet above a superconductor has been demonstrated, particularly with regard to high temperature superconductors. When the magnet is levitated above the superconducting plane, the superconductor operates to exclude the magnet's field in accordance with the Meissner effect. Eddy currents occur in the superconductor such that a mirror image effect is produced and the magnet is repelled. This phenomenon is demonstrated in FIG. 1 where a magnet 1 is levitated above a superconducting plane 2.

The magnitude of the flowing current (I) in the superconducting plane is limited by the critical current of the superconducting material employed to fabricate the superconducting plane 2. In FIG. 1 the height at which the magnet 1 is levitated above the superconducting plane 2 is not controlled, and assumes an equilibrium position.

The following chronologically ordered U.S. Patents and journal articles are referenced as describing various aspects of superconductor-induced levitation and related issues.

In U.S. Pat. No. 3,327,265, issued Jun. 20, 1967, entitled "Superconductive Device for Causing Stable and Free Floating of a Magnet in Space", van Geuns et al. describe a suspension system that suspends a permanent bar magnet over a plate of superconductive material. The plate includes apertures 3 and 4 that locally eliminate a mirror-image effect for attenuating the induced magnetic field near the poles of the magnet.

In U.S. Pat. No. 3,951,074, issued Apr. 20, 1976, entitled "Secondary Lift for Magnetically Levitated Vehicles", Cooper discloses an arrangement of magnets for providing a secondary lift effect for a magnetically levitated vehicle.

In U.S. Pat. No. 4,797,386, issued Jan. 10, 1989, entitled "Superconductor-Magnet Induced Separation", Gyorgy et al. describe superconductivity-magnetic induced separation in which a need for geometry and/or ancillary elements for lateral stabilization are said to be avoided. Superconducting elements are made of Type II superconductors such as barium-yttrium copper oxide. A magnet is levitated over a superconducting support body and induces vortices 5 and 6 for laterally stabilizing the magnet.

In an article entitled "Levitation of a Magnet over a Flat Type II Superconductor", Journal of Applied Physics, Vol. 63, pages 447–450 (Jan. 15, 1988) F. Hellman et al. disclose the levitation of a magnet over a Type II superconductor in a manner similar to that described in the immediately preceding U.S. Patent.

In U.S. Pat. No. 4,843,504, issued Jun. 27, 1989, entitled "Superconductor Devices Useful for Disk Drives and the Like", Barnes describes superconducting materials for use in magnetic recording devices. Superconducting Josephson junction devices are shown to be used for detecting magnetic field changes.

In U.S. Pat. No. 4,879,537, issued Nov. 7, 1989, entitled "Magnetic Suspension and Magnetic Field Concentration Using Superconductors", Marshall et al. describe a device for suspending a load by the use of a magnetic field and superconductive material. A magnetic is suspended over a superconductor so as to provide a magnetic field that penetrates the superconductor. A superconducting disk is comprised of a Type II superconductor comprised of $YBa_2Cu_3O_x$ and the magnet is comprised of Neodymium-Iron-Boron. In col. 3, a discussion is made of levitation forces for a Type II superconductor, as described by F. Hellman et al. in the above referenced Journal of Applied Physics article.

In U.S. Pat. No. 4,892,863, issued Jan. 9, 1990, entitled "Electric Machinery Employing a Superconductor Element" Agarwala describe a superconductor bearing comprised of Type I or Type II superconducting material.

In an article entitled "Observation of Enhanced Properties in Samples of Silver Oxide Doped $YBa_2Cu_3O_x$" Applied Physics Letters, Vol. 52, pages 2066–2067 (Jun. 13, 1988), P. N. Peters et al. describe the addition of silver oxide to $YBa_2Cu_3O_x$ to provide a material that exhibits attractive forces in gradient magnetic fields, both normal and tangential to the surfaces, which are more than twice the sample weight. This is shown to enable the suspension of a sample of this material below a rare earth magnet.

In an article entitled "Magnetic Hysteresis of High-Temperature $YBa_2Cu_3O_xAgO$ Superconductors: Explanation of Magnetic Suspension", Modern Physics Letters B, Vol. 2, pages 869–874 (August, 1988) C. Y. Huang et al. discuss in greater detail the characteristics of the silver oxide doped $YBa_2Cu_3O_x$ superconductor described in the immediately preceding article. The presence of extremely strong pinning centers in the superconductor is discussed.

In an article entitled "Levitation Effects Involving High $T_c$ Thallium Based Superconductors" Applied Physics Letters, Vol. 53, pages 1119–1121 (Sep. 19, 1988) Harter et al. describe a stabile levitation equilibria exhibited by the superconductor $Tl_2Ca_2Ba_2Cu_3O_{10}$.

In an article entitled "Friction in Levitated Superconductors" Applied Physics Letters, Vol. 53, pages 1554–1556 (Oct. 17, 1988) E. H. Brandt describes the levitation of Type I and Type II superconductors above a magnet. The author points out that, in contrast to Type I superconductors, levitated Type II superconductors with flux pinning exhibit a continuous range of stable positions and orientations.

In an article entitled "Magnetic Suspension of Superconductors at 4.2K" Applied Physics Letters, Vol. 53, pages 2346–2347 (Dec. 5, 1988) R. Adler et al. describe suspension at low temperature for a Type II superconductor such as $Nb_3Sn$.

And, in an article entitled "Flux Penetration in High-$T_c$ Superconductors: Implications for Magnetic Suspension and Shielding" Applied Physics, Vol. A48, pages 87–91 (January, 1989) D. Marshall et al. describe two phenomena which result from flux penetration and pinning in a superconductor. These phenomena include magnetic suspension, wherein a magnet is suspended stably beneath another magnet with a superconductor interposed between the two magnets, and the intensification of magnetic flux upon passing through a superconductor.

What is not taught by this prior art, and what is thus an object of the invention to provide, is the active control of the levitation of a magnetic body relative to a superconductor.

A further object of the invention is to provide a superconducting structure comprised of Josephson junction devices that enable the controlled levitation and positioning of a magnetic body relative to the superconducting plane.

Another object of the invention is to provide a superconducting plane that includes a plurality of electrically addressable devices to enable the precise control of levitation height and a position of a magnetic body above a superconductor.

SUMMARY OF THE INVENTION

The foregoing and other problems are overcome and the objects of the invention are realized by an electrically addressable device which provides precise control of the levitation of a magnet above a superconductor.

More particularly, the invention pertains to apparatus for levitating a magnetic body. The apparatus includes a structure having a planar or a curved surface comprised of a material that is superconductive below a critical temperature. The structure includes at least one device, preferably a Josephson junction device, for passing a variable current therethrough for controlling an amount of magnetic flux penetration into the structure. At a first current value magnetic flux generated by the magnetic body is excluded from the structure and the magnetic body is levitated above a surface of the structure. At a second current value the magnetic flux penetrates the structure such that the levitating magnetic body approaches a surface of the structure.

An embodiment of the invention includes a structure that is differentiated into an array of regions comprised of superconductive material, each of the regions being separated from immediately adjacent regions by a gap having a width equal to a tunnelling distance. This arrangement defines a Josephson tunnel junction device between each region and each of the immediately adjacent regions. In an illustrated embodiment each of the regions has an approximately square surface area having semi-circular concave corners for forming, at each corner, a substantially circular aperture with the corner of each of three adjacent regions. Other shapes may be employed for tiling the surface such as, by example, triangular and hexagonally shaped regions.

The magnetic body is selected to have a dimension that is equal to or exceeds a spacing between adjacent apertures. Magnetic flux lines passing in opposite directions through two adjacent apertures stabilize the levitating magnetic body against lateral motion. A source of electrical current that is coupled individually to each of the regions selectively changes the direction of flux lines passing through one or more apertures for causing a lateral movement of, or a rotation of, the levitating magnetic body relative to the surface of the structure.

Embodiments of the invention are disclosed for transporting a material that is supported by the magnetic body and for operating a display device.

BRIEF DESCRIPTION OF THE DRAWING

The above set forth and other features of the invention are made more apparent in the ensuing Detailed Description of the Invention when read in conjunction with the attached Drawing, wherein.

DETAILED DESCRIPTION OF THE INVENTION

Figure 1:
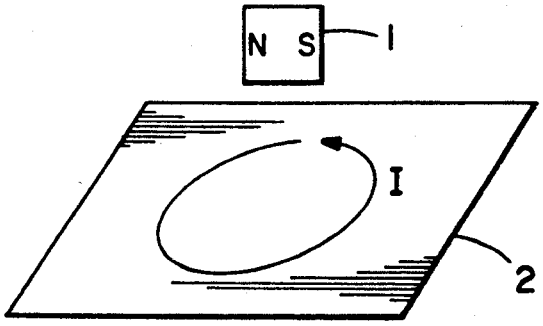
FIG. 1 PRIOR ART
FIG. 1 is an elevational view showing, in accordance with the prior art, a magnet levitating above a superconducting plane.
Figure 2:
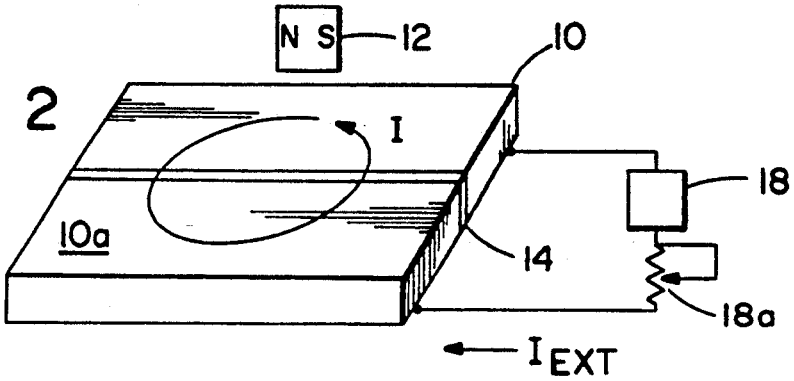
FIG. 2 is an elevational view showing a magnet being controllably levitated above a Josephson junction device.

In accordance with the embodiment of the invention illustrated in FIG. 2 there is now disclosed a structure for controlling the position of a levitated magnetic body 12 over a surface 10*a* of a superconductor 10, the position being controlled by controlling the magnitude of a current in the superconductor 10.

Figure 3:
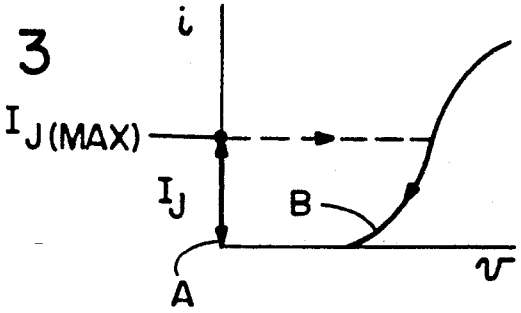
FIG. 3 a graphically illustrates a current-voltage characteristic of the Josephson junction device of FIG. 2.

In FIG. 2 this structure includes a two terminal Josephson junction device 14 formed across a plane of the superconductor 10. A current-voltage characteristic of a typical Josephson tunnel junction device is shown in FIG. 3. In the zero voltage regime (A) of the Josephson tunnel junction 14 a supercurrent flows which is controlled by an external power supply 18. For this condition the total supercurrent is a combination of the currents induced by the magnet 12 and the current ($I_{EXT}$) that results from the external power supply 18. To achieve control over the power supply current a simple rheostat 18*a* may be employed. By increasing the magnitude of the external current provided by the power supply 18, so that the total current exceeds the critical current of the superconductor 10, the superconductor 10 becomes normal and levitation of the magnet 12 ceases. Between the zero voltage supercurrent (regime A) and a point where the increased current causes the superconductor 10 to go normal (point B) there exist a plurality of different levitation heights that the magnet 12 may assume. The external current supplied by the power supply 18 may have either polarity for adding to or subtracting from the total current. Alternating currents (ac) currents may also be employed. The Josephson junction device is preferably operated at a current that is less than the maximum Josephson current ($I_{J(MAX)}$) so as to remain on the y-axis of the curve of FIG. 3.

The use of a Josephson junction device is important in that this type of device is operable to conduct both a normal current and a supercurrent. In contradistinction, an insulating gap would allow no current to pass, while a resistive link would result in power dissipation. The Josephson junction device has a maximum current density of approximately $10^5$ Amp/cm$^2$. It should be noted that the term "Josephson junction device" as employed herein is intended to include tunnel junction devices, as illustrated, and also weak link devices such as microbridges. For this latter embodiment small constrictions of an appropriate width are disposed between adjacent tiles, as opposed to a tunnel barrier.

Figure 4:
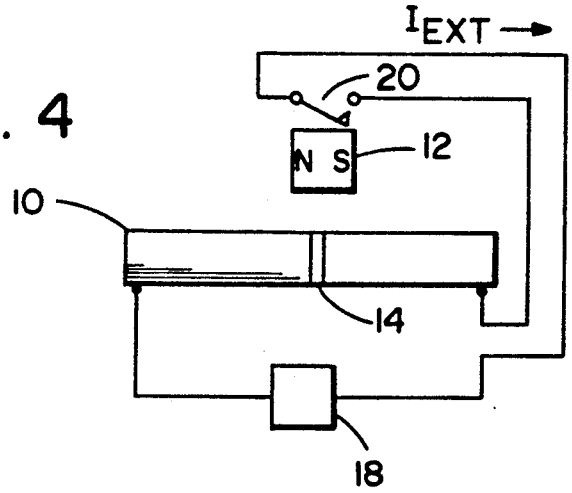
FIG. 4 is a side view showing a magnet being controllably levitated within a closed-loop vertical positioning system.

In accordance with the invention the height of the magnet 12 above the Josephson junction device 14 is controlled by controlling the magnitude of $I_{EXT}$. This control of magnet 12 height may be employed in a number of novel and useful applications. As an example, and in the closed-loop vertical positioning system depicted in FIG. 4, as the magnet 12 rises above the underlying superconductor 10 it makes electrical contact with and closes a circuit, shown schematically as a normally-open switch 20, causing $I_{EXT}$ to flow. All or a portion of this current flows in the Josephson junction device 14, thereby increasing the total current and causing the magnet 12 to descend, thus breaking the established electrical contact through switch 20. As a result, the height of the magnet 12 above the superconductor 10 oscillates between the switch-open position and the switch-closed position. The levitating magnet 12 may also be employed with a non-contact type of switch, such as a Hall-effect device, or an optical beam that is interrupted at a predetermined height above the superconductor 10. It should be noted that this technique may be employed to open or close any external circuit, and not just the circuit that provides current to the Josephson junction device. One application for the controlled levitation of the magnet 12 is to transport an object that is supported by or coupled to the magnet 12. This technique is useful in, for example, a harmful or poisonous environment and/or for transporting quantities of toxic or radioactive substances. As the current $I_{EXT}$ may be quite precisely controlled, precise magnet positioning is achieved resulting in the execution of precise positioning of the object.

Figure 5A:
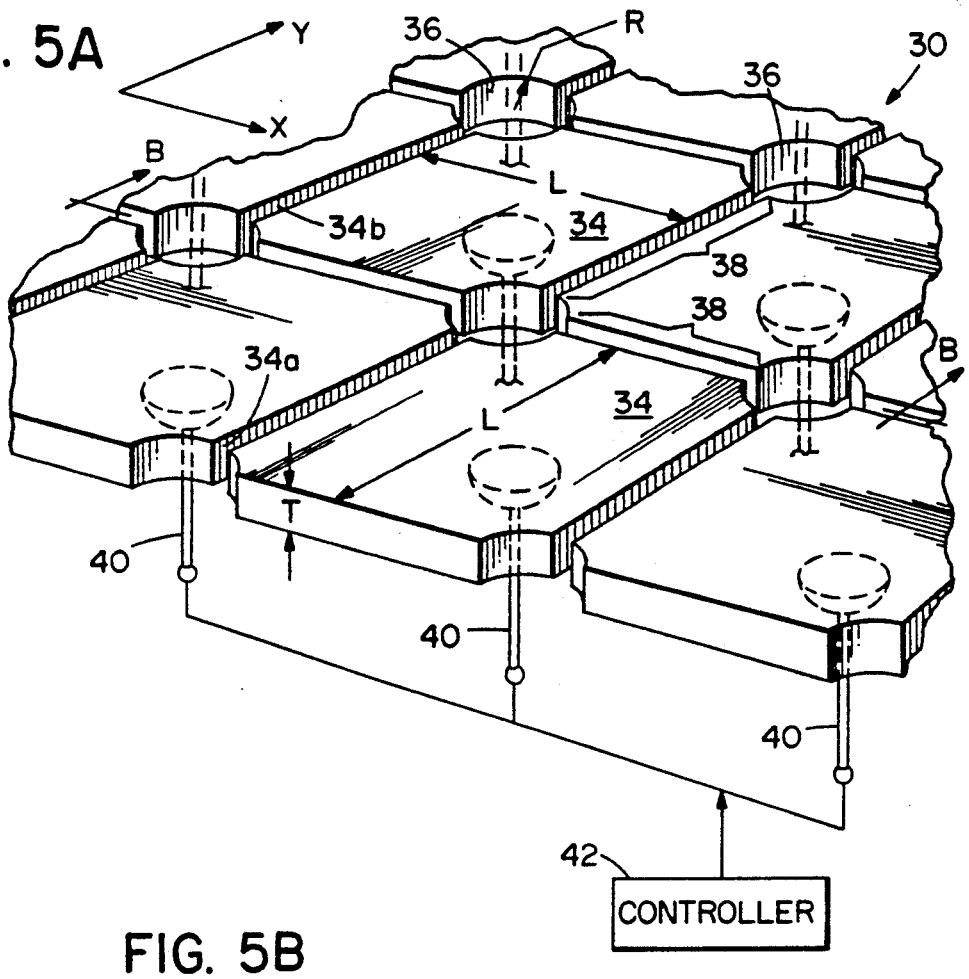
FIG. 5A is an elevational view of an electrically addressable superconducting planar array of Josephson junction devices that enable the precise control of levitation height and position of a magnet.
Figure 5B:
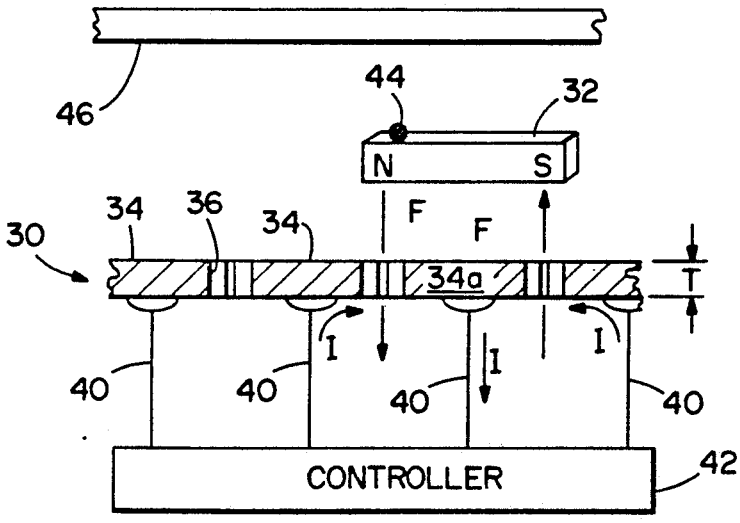
FIG. 5B is a cross-sectional view taken along the section line B—B of FIG. 5A.

In this regard reference is made to FIGS. 5A and 5B as showing one embodiment of a precise magnet positioning and levitation system suitable for transporting an object attached to or supported by the magnet. This configuration of a superconductor array 30 enables a magnet 32 to be moved to a desired x-y position relative to an array 30 x-y coordinate system. The superconductor array 30 is formed of a mosaic of, by example, approximately square-shaped tiles 34 of length L on a side and of thickness T. The corners of each tile 34 are formed to define apertures 36 of radius R. The vertical facets 34*a* of the tiles 34 are separated by a distance selected so as to form a rectangular Josephson junction 38 of size LxT between each side of a tile 34 and its four nearest neighbor tiles. Thus, in this embodiment, each tile 34 is surrounded by four Josephson junction devices 38.

It should be noted that the square tiles are but one suitable tile shape. Other shapes for tiling the surface of the plane include, but are not limited to, triangles, hexagons, and, in general, any polygonal shape. For a triangularly shaped tile each tile is surrounded by three Josephson junction devices, for a hexagonally shaped tile each tile is surrounded by six Josephson junction devices, etc. For these alternate shapes the apertures are formed at the vertices of each tile. It should further be noted that teaching of the invention is not limited only to planar surfaces and that curved surfaces may also be tiled as described above. Also, tiles of differing shapes and sizes may be employed together.

In a quiescent state, with no currents passing through the Josephson junctions 38, a magnetic flux (F) consisting of an integral number of fluxoids threads or passes each of the apertures 36. Referring to FIG. 5B it is assumed, by way of example, that only two nearest neighbor apertures contain flux. Each aperture 36 passes the same amount of flux but in opposite directions. The permanent magnet 32, having opposed North (N) and South (S) poles as shown and dimensions of approximately TxTxL, is attracted to the flux-passing pair of apertures. If the threaded flux is initially large, the magnet 32 is held at the surface of the array 30. If the flux is changed so that the amount of flux threading the two apertures 36 approaches zero, the attraction to the magnet 32 decreases and the magnet 32 levitates at some height above the surface of the array 30. However, the magnet 32 tends to remain in the neighborhood of the two apertures. When the Josephson junctions 38 are activated by the application of a current (I) thereto, such that the flux threads an adjacent pair of apertures 36, the magnet 32 will be attracted to the new pair of apertures, thereby changing its lateral position relative to the array 30 x-y coordinate system. If the flux is once more increased at the new pair of apertures 36 the magnet 32 will be attracted to the surface of the array 30 and held, or "clamped, at the new x-y position. As will be described, a similar sequence of control currents are employed to rotate the magnet 32.

The controlled activation of the Josephson junction devices 38 is achieved through the use of a plurality of electrodes 40, individual ones of which are coupled to one of the tiles 34 in a manner depicted in FIGS. 5A and 5B. Each of the electrodes is connected to a controller 42 that applies a current to one or more pairs of adjacent electrodes 40 for establishing the flow of current (I) through the Josephson junction device 38 that is interposed between two adjacent tiles 34. As was previously described, as the current flow is increased through the appropriate Josephson junctions the levitating magnet 32 approaches the surface of the array 30. The magnitude of I may vary within a range of several milliamps to several hundred milliamps, the magnitude being a function of the tunnel junction area between adjacent tiles By selectively applying current to pairs of tiles 34 the magnet 32 is translated across or rotated about the surface of the array 30 in a controlled manner.

In regard to the embodiments described thus far the superconductor material may be a low temperature superconductor or a high temperature superconductor. By example, Niobium is one suitable low temperature superconductor material and $YBa_2Cu_3O_x$ or $Tl_2Ca_2Ba_2Cu_3O_{10}$ are two suitable high temperature superconducting materials. The use of $YBa_2Cu_3O_x$ is advantageous in that it enables operation of the array 30 at a temperature corresponding to that of liquid nitrogen ($LN_2$), or 77K. The magnet 32 is preferably comprised of rare earth material such as SmCo. The dimension L is typically within a range of approximately two micrometers to approximately 100 micrometers, or greater, with 20 micrometers being a typical value. The thickness T is typically in the range of approximately 100 nanometers to approximately one micrometer. A typical radius (R) of each of the apertures 36 is approximately two micrometers for L equal to approximately 20 micrometers. The vertical facets 34*a* of the tiles 34 are spaced apart from one another by a distance of approximately 20 Angstroms to approximately 30 Angstroms. Interposed between vertical facets 34*a* of adjacent tiles 34 is a Josephson tunnel barrier 34*b*. The material of Josephson tunnel barriers 34*b* is selected to be compatible with the selected superconductor material. By example, for the low temperature superconductor material Niobium the barrier material 34b may be comprised of niobium oxide or aluminum oxide. For the high temperature superconducting material the insulating material may be comprised of barium fluoride, magnesium oxide, strontium titanate, or the non-superconducting oxide material $PrBa_2Cu_3O_x$. It is also within the scope of the invention to provide a semiconductor barrier material 34b such as one comprised of silicon-germanium, germaniumtellurium, or cadmium sulfide. The use of a semiconductor barrier material is advantageous in that it permits the distance between the vertical facets 34a to be wider due to the lower tunnel barrier potential present within the semiconductor material. It is also within the scope of the invention to provide a vacuum between the vertical facets 34a in place of an insulating film barrier.

The fabrication of the array 30 may be achieved by conventional semiconductor photolithographic techniques. As an example, for a superconducting array comprised of a high temperature superconductor, processing begins with a substrate, such as MgO, through which a plurality of via holes are made. Each of the via holes is formed at a position where an electrode 40 is required. The via holes are metalized and the substrate is planarized. A layer of a high temperature superconductor is applied to the surface of the substrate to the desired thickness T. A layer of photoresist is applied over the superconductor layer, followed by the photolithographic definition of the gaps 34a, between the tiles 34, and the apertures 36 at the tile corners. The structure is next processed to remove the exposed photoresist and portions of the superconductor material to form the desired mosaic pattern. The selected insulating film material 34b is then evaporated or otherwise deposited or grown so as to fill the gaps 34a and, if desired, the apertures 36. The photoresist layer is then removed.

One application for the array 30 is in the manufacture of integrated circuits. One example is the customization of logic chips. In that the design of a new chip is a lengthy and expensive process, it is often desirable to employ a "generic" design which is customized at a late stage of manufacture into a desired configuration. Such generic chips often are provided with open circuits which are required to be closed to make the desired circuit connections. In this regard, the magnet 32 supports and transports a quantity of electrically conductive material, such as a solder ball 44. The integrated circuit chip is disposed such that an active circuit surface area 46 is supported above the array 30 at a height that is within reach of the levitating magnet 32. The controller 42 is employed to sequentially activate the Josephson junctions 38 so as to transport the magnet 32, and the ball of solder 44, to a desired location upon the active circuit surface 46. Once positioned, the ball of solder 44 is melted with a laser (not shown) or some other suitable means so as to make an electrical connection between two points upon the active circuit surface 46. It should be noted that a significant number of magnets may be simultaneously controlled in this manner for moving over a single array 30.

Another similar application of the invention is in conveying material so as to repair a mask of the type used to control the exposure of a photoresist material.

FIGS. 6A–6D illustrate a further embodiment of the invention wherein the superconducting array 30 is employed as an element of a display device. The display device incorporates the array 30 and the electrodes 40 and is constructed as previously described. The electrodes 40 are controlled such that a sequence of currents causes a suspended magnetized body to rotate about an axis while the body is levitated above the surface of the array 30.

Figure 6A:
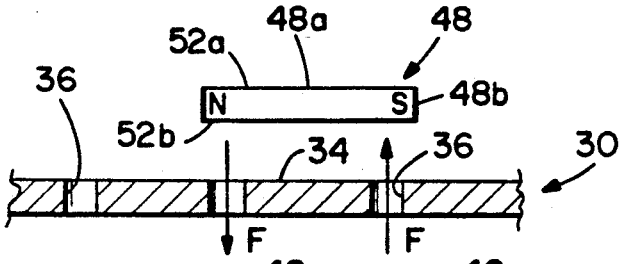
FIGS. 6A-6D illustrate the rotation of a levitating magnet about an edge thereof.
Figure 6B:
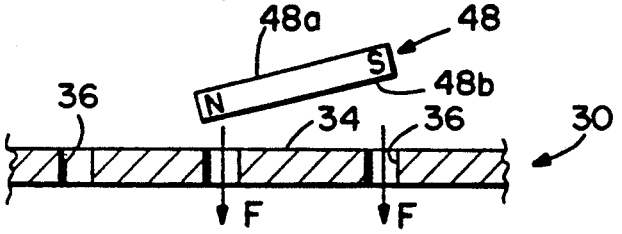
Figure 6C:
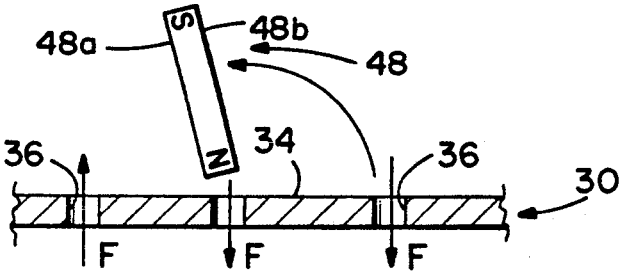
Figure 6D:
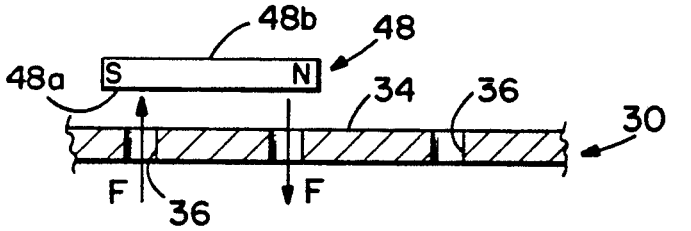

The magnetized body is provided as a flat, approximately square magnet 48 that is polarized in a direction parallel to one of its sides. The magnet 48 has a length and a width that is approximately equal to the dimensions of an underlying tile 34. In FIG. 6A the magnet 48 is initially held in place above one particular tile 34 by lines of magnetic flux (F) which rise through two adjacent apertures 36 at corners of the tile 34 and which descend through two other adjacent apertures 36. In FIG. 6B the polarity of the flux through two apertures is reversed by passing a current through the associated Josephson junction 38. As a result, that side of the magnet 48 is repelled and will tend to move up away from the plane of the array 30. However, the opposite side of the magnet 48 remains attracted by the descending lines of flux. As a result, the magnet 48 rotates about an axis parallel to the side of the magnet 48 that is held in place. That is, the magnet 48 appears to operate in a manner similar to a hinged door. Referring to FIG. 6C, as the magnet 48 approaches a position that is perpendicular to the array 30 another current is provided to generate flux through the two apertures on the opposite side of the adjacent tile 34. This flux attracts the rotating edge of the magnet 48, thus causing the magnet 48 to swing through the perpendicular position and come to rest above the adjacent tile (FIG. 6D). As can be seen, the magnet 48 has been rotated into a new position and a new orientation. An alternative method is to reverse the flux from the "hinge" side of the tile to the opposite side of the tile while the magnet is in the perpendicular position. This causes the magnet to return to rest on the same tile after it is rotated.

In accordance with this embodiment of the invention the magnet 48 is provided with a dark surface 48a on one side and a lighter surface 48b on the opposite side. Thus, any desired light and dark pattern can be formed by controllably rotating a plurality of the magnets 48.

It is also within the scope of the invention to provide cubic magnets having sides of different colors. The cubic magnets are rotated in a manner described above so as to provide on a visible surface of each cubic magnet a desired one of six colors.

The display device may be operated with the array 30 of tiles 34 completely covered with the magnets 48, or with only a partial covering of magnets.

Figure 7:
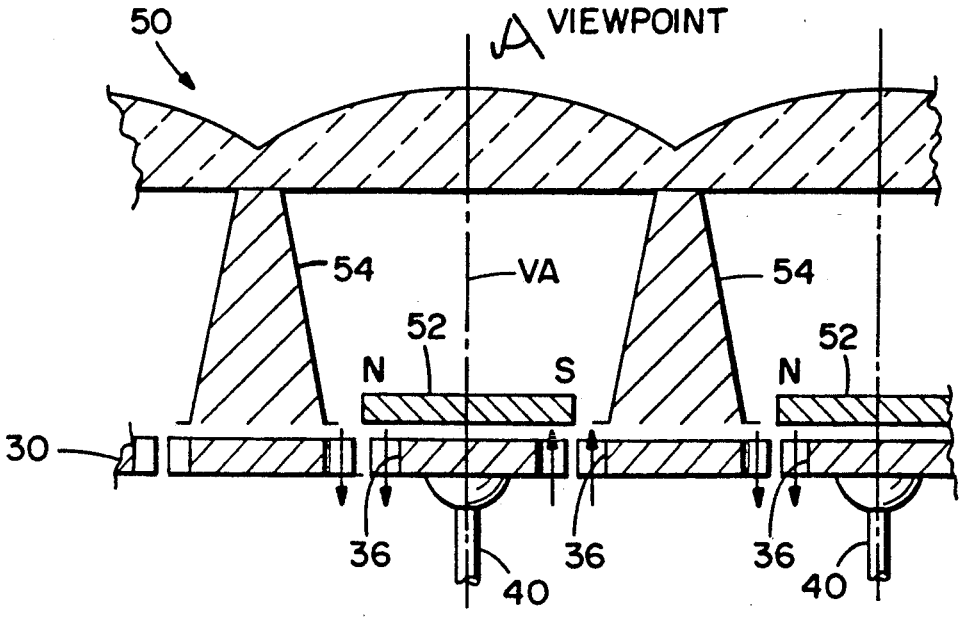
FIG. 7 illustrates, in cross-section, a display device that incorporates the superconducting array of FIG. 5A.

Referring to FIG. 7 there is shown a further embodiment of a display device 50 that includes means for enclosing each magnet 52 within a cavity or chamber 54. The walls of the chamber 54 tend to constrain the lateral motion of the enclosed magnet 52 and thus reduce the precision required of the controlling currents while preventing the loss of any magnets. A fly eye-type transparent lens 56 is provided at the top of each chamber 54 so as to form an image with high contrast for the case where the magnets 52 do not cover the entire superconducting plane 30. Beneath each lens 56 is a layer of material into which the chambers 54 are formed, each chamber containing a single one of the magnets 52. Preferably, each magnet 52 and its associated chamber 54 are rectangular in shape, as viewed from above, and have a long direction perpendicular to an axis about which the magnets are rotated. In this embodiment the magnets 52 are constrained from completely rotating through a vertical axis (VA) and the controller 42 need not be responsible for controlling this degree of freedom. For this embodiment an upper surface of each of the magnets 52 may be made dark and the underlying surface of the array 30 is made lighter, or vice versa. A partial rotation of the magnet 52 thus provides a visible contrast by exposing to view the underlying lighter surface of the array 30.

It should be realized that the display device may be made very thin. Also, the addition of small areas of magnetic films to the array 30 can be employed to preserve the image in the absence of input power. Of course, for all of these various embodiments of the invention it is required to operate the superconducting array 30 below its associated critical transition temperature in order to obtain the benefit of the operation of the Josephson junction devices 38 that are integrally formed within the array.

It should also be realized that the controller 42 may be embodied in any apparatus suitable for controllably applying the required currents to the Josephson junction devices. Controller 42 may include a data processor coupled to a plurality of current switches or a display controller device having outputs that control the application of the currents.

Thus, while the invention has been particularly shown and described with respect to a preferred embodiment thereof, it will be understood by those skilled in the art that changes in form and details may be made therein without departing from the scope and spirit of the invention.

I claim:

1. Apparatus for levitating a magnetic body, the apparatus including a structure comprised of a material that is superconductive below a critical temperature, the structure including at least one Josephson junction device means for receiving a controlled current flow to establish an amount of magnetic flux penetration into said structure, wherein at a first current flow magnetic flux generated by a magnetic body is excluded from the structure and the magnetic body is levitated above a surface of the structure, and wherein at a second current flow the magnetic flux penetrates the structure such that the levitating magnetic body approaches the surface of the structure.

2. Apparatus as set forth in claim 1 wherein the structure is differentiated into an array of regions each of which is comprised of superconductive material, each of the regions being separated from immediately adjacent regions by a gap, the gap having a width approximately equal to a tunnelling distance for an associated Josephson junction device means that is disposed between each region and each of the immediately adjacent regions.

3. Apparatus as set forth in claim 2 wherein each of the regions is coupled to a source of electrical current for providing a controlled current flow through at least one associated Josephson junction device means.

4. Apparatus as set forth in claim 2 wherein each of the regions of said structure has an aperture formed at vertices thereof.

5. Apparatus as set forth in claim 2 wherein each gap contains a tunnel barrier material.

6. Apparatus as set forth in claim 5 wherein each of the regions of said structure is comprised of a low transition temperature superconductor material, and wherein the tunnel barrier material is comprised of an oxide of the low temperature superconductor material.

7. Apparatus as set forth in claim 5 wherein each of the regions of said structure is comprised of Niobium, and wherein the tunnel barrier material is comprised of material selected from the group consisting essentially of niobium oxide and aluminum oxide.

8. Apparatus as set forth in claim 5 wherein each of the regions of said structure is comprised of a high transition temperature superconductor material, and wherein the tunnel barrier material is selected from the group consisting essentially of barium fluoride, magnesium oxide, strontium titanate, and $PrBa_2Cu_3O_x$.

9. Apparatus as set forth in claim 5 wherein each of the regions of said structure is comprised of a high transition temperature superconductor material, and wherein the tunnel barrier material is comprised of a semiconductor material.

10. Apparatus as set forth in claim 3 wherein each of the regions of said structure has an aperture formed at vertices thereof, and wherein a spacing between adjacent apertures is a function of a dimension of a magnetic body to be levitated above said structure.

11. Apparatus as set forth in claim 10 wherein magnetic flux lines passing in opposite directions through two adjacent apertures stabilize a levitated magnetic body against lateral motion, and wherein the source of electrical current includes means for selectively energizing the regions for controlling the direction of flux lines passing through one or more apertures for causing a lateral movement of the levitated magnetic body relative to the surface of the structure.

12. Apparatus as set forth in claim 11 wherein a levitated magnetic body supports a substance, and wherein the mean for selectively energizing operates to selectively energize the regions so as to transport the levitated magnetic body and the supported substance within a plane parallel to the surface of the structure and within a plane orthogonal to the surface of the structure.

13. Apparatus as set forth in claim 10 wherein magnetic flux lines passing in opposite directions through two adjacent apertures stabilize a levitated magnetic body against lateral motion, and wherein the source of electrical current includes means for selectively energizing the regions for controlling the direction of flux lines passing through one or more apertures for causing a rotation of the levitated magnetic body, about an axis thereof, relative to the surface of the structure.

14. Apparatus as set forth in claim 13 wherein a least one surface of a levitated magnetic body has a visually distinct characteristic relative to another surface of the levitated magnetic body.

15. Apparatus as set forth in claim 14 wherein the visually distinct characteristic is color.

16. Apparatus as set forth in claim 13 wherein a least one surface of a levitated magnetic body has a visually distinct characteristic relative to the surface of the structure.

17. Apparatus for controllably positioning a magnetic body upon or above a surface, the surface being differentiated into a plurality of regions each of which is comprised of superconductive material, each of the regions having a plurality of edges that are separated from an edge or edges of immediately adjacent regions and forming a Josephson tunnel junction device between each region and each immediately adjacent region, the apparatus including means for coupling each of the Josephson tunnel junction devices to a source of variable current flow for controlling an amount of magnetic flux penetration into the surface, wherein for a first current flow a magnetic flux generated by a magnetic body is excluded from the surface of the structure for causing the magnetic body to be levitated above the surface of the structure, and wherein for a second current flow a magnetic flux generated by a levitated magnetic body penetrates the surface for causing the levitated magnetic body to approach the surface of the structure.

18. Apparatus as set forth in claim 17 wherein each of the regions has apertures formed at edges thereof, and wherein a spacing between adjacent apertures is selected as a function of a dimension of a magnetic body to be levitated.

19. Apparatus as set forth in claim 18 wherein magnetic flux lines passing in opposite directions through two adjacent apertures stabilize a levitated magnetic body against lateral motion, and wherein the source of electrical current includes means for selectively energizing the regions for controlling the direction of flux lines passing through one or more apertures for causing a lateral movement of the levitated magnetic body relative to the surface of the structure or for causing a rotation of the levitated magnetic body relative to the surface of the structure.

20. Apparatus as set forth in claim 19 wherein the levitated magnetic body includes at least two surfaces that are visually distinct one from the other.

21. Apparatus as set forth in claim 19 wherein the levitated magnetic body includes at least one surface for supporting a material that is conveyed by the levitated magnetic body.

22. A method of levitating a magnetic body relative to a superconducting surface, comprising the steps of:

differentiating the surface into at least two regions having a Josephson junction therebetween;

initially positioning the magnetic body over the surface; and controlling a current flow through the Josephson junction for controlling a height at which the magnetic body levitates above the surface.

23. A method of rotating a magnetic body relative to a superconducting surface, comprising the steps of:

differentiating a layer of superconducting surface material into a plurality of regions each of which has a Josephson junction formed along an edge thereof that borders another region, each of the regions including magnetic flux passing apertures;

initially positioning the magnetic body such that opposing first and second ends thereof are disposed over a first and a second flux passing aperture, respectively;

controlling a current flow through the Josephson junctions for causing a first end of the magnetic body to rise while the second end is constrained to maintain a substantially constant vertical position; and controlling the current flow through the Josephson junctions for causing the first end of the magnetic body to descend toward a third flux passing aperture such that the first end rotates about the second end.

24. A method for transporting a substance from a first position to a second position, comprising the steps of:

differentiating a layer of superconductive material into a plurality of regions, each of the regions having a Josephson junction device formed along an edge thereof that borders another region.

initially positioning a magnetic body at a first position relative to a surface of the differentiated layer of superconductive material, the magnetic body being adapted to support a substance to be transported; and selectively controlling a current flow through the Josephson junction devices for causing the magnetic body and a substance supported by the magnetic body to be levitated above the surface and for causing the magnetic body and the substance supported by the magnetic body to be translated over the surface from the first position to a second position relative to the surface.

25. A method for displaying a visually distinct pattern to an observer, comprising the steps of:

differentiating a layer of superconductive material into a plurality of regions, each of the regions having a Josephson junction device formed along an edge thereof that borders another region;

providing a plurality of magnetic bodies over a surface of the differentiated layer of superconductive material, each of the magnetic bodies having at least one surface that is visually distinct from another surface of the magnetic body; and selectively controlling a current flow through the Josephson junction devices in accordance with a pattern to be displayed to an observer for causing a selected surface of each of the plurality of magnetic bodies to be visible to the observer.

26. A method for displaying a visually distinct pattern, comprising the steps of:

differentiating a layer of superconductive material into a plurality of regions, each of the regions having a Josephson junction device formed along an edge thereof that borders another region;

providing a plurality of magnetic bodies over a surface of the differentiated layer of superconductive material, each of the magnetic bodies having at least one surface that is visually distinct from the surface of the differentiated layer of superconductive material, each of the magnetic bodies being provided with a first angular orientation with respect to the surface of the differentiated layer of superconductive material, the first angular orientation causing the at least one visually distinct surface of each of the magnetic bodies to be visible to an observer; and selectively controlling a current flow through the Josephson junction devices in accordance with a pattern to be displayed to the observer for varying the angular orientation of at least one of the plurality of magnetic devices for causing an underlying portion of the surface of the differentiated layer of superconductive material to be visible to the observer.

* * * * *